US007011139B2

(12) United States Patent
Schoen et al.

(10) Patent No.: US 7,011,139 B2
(45) Date of Patent: Mar. 14, 2006

(54) METHOD OF CONTINUOUS CASTING NON-ORIENTED ELECTRICAL STEEL STRIP

(76) Inventors: Jerry W. Schoen, 6315 Gemstone Dr., Middletown, OH (US) 45044; Robert J. Comstock, Jr., 509 Southwick Pl., Trenton, OH (US) 45067

( * ) Notice: Subject to any disclaimer, the term of this patent is extended or adjusted under 35 U.S.C. 154(b) by 0 days.

(21) Appl. No.: 10/374,595

(22) Filed: Feb. 25, 2003

(65) Prior Publication Data

US 2004/0016530 A1 Jan. 29, 2004

Related U.S. Application Data

(60) Provisional application No. 60/378,743, filed on May 8, 2002.

(51) Int. Cl.
*B22D 11/00* (2006.01)

(52) U.S. Cl. ..... 164/476; 164/477; 164/417

(58) Field of Classification Search ..... 164/476, 164/477, 417, 414, 455
See application file for complete search history.

(56) References Cited

U.S. PATENT DOCUMENTS

| | | | | |
|---|---|---|---|---|
| 3,178,324 A | | 4/1965 | Grange et al. | |
| 3,935,038 A | * | 1/1976 | Shimoyama et al. | 148/110 |
| 4,046,602 A | | 9/1977 | Stanley | 148/111 |
| 4,560,423 A | | 12/1985 | Shimoyama et al. | 148/111 |
| 4,632,708 A | | 12/1986 | Konno et al. | 148/113 |
| 4,645,547 A | | 2/1987 | Krause et al. | 148/111 |
| 4,666,535 A | | 5/1987 | Benford | 148/113 |
| 4,715,905 A | * | 12/1987 | Nakaoka et al. | 148/111 |
| 4,781,769 A | | 11/1988 | Toker et al. | 148/29 |
| 4,793,873 A | | 12/1988 | Dean | 148/113 |
| 4,863,532 A | | 9/1989 | Kuroki et al. | 148/307 |
| 4,871,402 A | | 10/1989 | Toker et al. | 148/113 |
| 4,888,066 A | | 12/1989 | Yoshitomi et al. | 148/113 |
| 4,906,305 A | | 3/1990 | McCormick et al. | 148/11.5 |
| 4,948,675 A | | 8/1990 | Toker et al. | 428/469 |
| 4,950,336 A | | 8/1990 | Tomita et al. | 148/111 |
| 4,964,922 A | | 10/1990 | Ames et al. | 148/111 |
| 4,968,361 A | | 11/1990 | Ames et al. | 148/110 |
| 5,037,493 A | | 8/1991 | Tomita et al. | 148/111 |
| 5,055,362 A | | 10/1991 | McCormick et al. | 428/683 |
| 5,062,905 A | | 11/1991 | Tomita et al. | 148/111 |
| 5,186,762 A | | 2/1993 | Ushigami et al. | 148/111 |
| 5,192,373 A | | 3/1993 | Wright et al. | 148/113 |
| 5,200,145 A | | 4/1993 | Krutenat et al. | 420/129 |
| 5,261,972 A | | 11/1993 | Kuroki et al. | 148/111 |
| 5,288,736 A | | 2/1994 | Schoen et al. | 148/111 |
| 5,421,911 A | | 6/1995 | Schoen | 148/111 |
| 5,421,912 A | * | 6/1995 | Kumano et al. | 148/111 |
| 5,482,107 A | * | 1/1996 | Judd | 164/480 |
| 5,512,110 A | | 4/1996 | Yoshitomi et al. | 148/113 |

(Continued)

*Primary Examiner*—Kevin P. Kerns
(74) *Attorney, Agent, or Firm*—Frost Brown Todd, LLC

(57) ABSTRACT

Non-oriented electrical steels are widely used as the magnetic core material in a variety of electrical machinery and devices, particularly in motors where low core loss and high magnetic permeability in all directions of the strip are desired. A method for producing a non-oriented electrical steel with low core loss and high magnetic permeability provides a steel that is produced from a steel melt which is cast as a thin strip or sheet, cooled, hot rolled and/or cold rolled into a finished strip. The finished strip is further subjected to at least one annealing treatment wherein the magnetic properties are developed, making the steel strip suitable for use in electrical machinery such as motors or transformers.

13 Claims, 7 Drawing Sheets

U.S. PATENT DOCUMENTS

| | | | | | |
|---|---|---|---|---|---|
| 5,547,519 | A | | 8/1996 | Murphy | 148/113 |
| 5,643,370 | A | | 7/1997 | Huppi | 148/111 |
| 5,653,821 | A | | 8/1997 | Choi et al. | 148/111 |
| 5,697,425 | A | | 12/1997 | Nanba et al. | 164/468 |
| 5,702,539 | A | | 12/1997 | Schoen et al. | 148/111 |
| 5,779,819 | A | | 7/1998 | Huppi | 148/308 |
| 5,913,987 | A | * | 6/1999 | Sung et al. | 148/111 |
| 5,955,201 | A | | 9/1999 | Loudermilk et al. | 428/450 |
| 5,968,291 | A | | 10/1999 | Iba et al. | 148/421 |
| 6,136,456 | A | | 10/2000 | Komatsubara et al. | 428/667 |
| 6,217,673 | B1 | | 4/2001 | Butler et al. | 148/111 |
| 6,231,685 | B1 | | 5/2001 | Anderson | 148/120 |
| 6,287,395 | B1 | | 9/2001 | Schriever et al. | 148/307 |
| 6,290,783 | B1 | | 9/2001 | Kawano et al. | 148/309 |
| 6,322,635 | B1 | | 11/2001 | Hayakawa et al. | 148/111 |
| 6,340,399 | B1 | | 1/2002 | Tanaka et al. | 148/308 |
| 6,361,621 | B1 | | 3/2002 | Fortunati et al. | 148/113 |

* cited by examiner

Strip heated to 1150°C and hot rolled at 1000°C from 2.4mm to 2.0 mm. Hot rolling strain of 105 per Equation IX Strip heated to 1150°C and hot rolled at 950°C from 2.4 mm to 1.65 mm. Hot rolling strain of 269 per Equation IX Strip heated to 950°C and hot rolled at 830°C from 2.4 mm to 1.73 mm. Hot rolling strain of 502 per Equation IX

METHOD OF CONTINUOUS CASTING NON-ORIENTED ELECTRICAL STEEL STRIP

CROSS-REFERENCE TO RELATED APPLICATIONS

This application claims the priority benefit of U.S. Provisional Patent Application Ser. No. 60/378,743, filed May 8, 2002, which application is hereby incorporated by reference in its entirety.

BACKGROUND OF THE INVENTION

Non-oriented electrical steels are widely used as the magnetic core material in a variety of electrical machinery and devices, particularly in motors where low core loss and high magnetic permeability in all directions of the strip are desired. The present invention relates to a method for producing a non-oriented electrical steel with low core loss and high magnetic permeability whereby the steel is produced from a steel melt which is cast as a thin strip, cooled, hot rolled and/or cold rolled into a finished strip. The finished strip is further subjected to at least one annealing treatment wherein the magnetic properties are developed, making the steel strip of the present invention suitable for use in electrical machinery such as motors or transformers.

The magnetic properties of non-oriented electrical steels can be affected by finished strip thickness, volume resistivity, grain size, purity and crystallographic texture of the finished strip. The core loss caused by eddy currents can be made lower by reducing the thickness of the finished steel strip, increasing the alloy content of the steel strip to increase the volume resistivity or both in combination.

Established methods for producing non-oriented electrical steels with conventional processing (thick slab casting, slab reheating, hot rolling and hot band annealing) use typical but non-limiting alloy additions of silicon, aluminum, manganese and phosphorus with, preferably, compositions which provide for a fully ferritic microstructure within which any residual nitrogen is in the form of large inclusions. Non-oriented electrical steels may contain up to about 6.5% silicon, up to about 3% aluminum, up to about 0.05% carbon (which must be reduced to below about 0.003% during processing to prevent magnetic aging), up to about 0.01% nitrogen, up to about 0.01% sulfur and balance iron with a small amount of impurities incidental to the method of steel making. Non-oriented electrical steels, including those generally referred to as motor lamination steels, are differentiated by proportions of additions such as silicon, aluminum and like elements made to increase the volume resistivity of the steel. Steels containing less than about 0.5% silicon and other additions to provide a volume resistivity of about 20 $\mu\Omega$-cm can be generally classified as motor lamination steels; steels containing about 0.5 to about 1.5% silicon or other additions to provide a volume resistivity of from about 20 $\mu\Omega$-cm to about 30 $\mu\Omega$-cm can be generally classified low-silicon steels; steels containing (about 1.5 to about 3.0% silicon or other additions to provide a volume resistivity of from about 30 $\mu\Omega$-cm to about 45 $\mu\Omega$-cm can be generally classified as intermediate-silicon steels; and, lastly, steels containing more than about 3.5% silicon or other additions to provide a volume resistivity greater than about 45 $\mu\Omega$-cm can be generally classified as high-silicon steels. Typically, these steels contain aluminum additions as well. Silicon and aluminum greatly increase the stability of the ferrite phase, thereby steels containing in excess of about 2.5% (silicon+aluminum) are ferritic, that is, no austenite/ferrite phase transformation will occur during heating or cooling. Such alloying additions increase volume resistivity and suppress eddy currents during AC magnetization, thereby lowering core loss. These additions also improve the punching characteristics of the steel by increasing the hardness. Conversely, increasing the alloy content makes the steel more difficult to manufacture owing to the added cost of alloying and increased brittleness, particularly when large amounts of silicon are employed.

Achieving a suitably large grain size in the finish rolled and annealed strip is desired to provide minimal hysteresis loss. The purity of the finish rolled and annealed strip can have a significant effect on core loss since the presence of a dispersed phase, inclusions and/or precipitates can inhibit grain growth during annealing, preventing the formation of an appropriately large grain size and orientation and, thereby, producing higher core loss and lower magnetic permeability in the final product form. Also, inclusions and/or precipitates in the finish annealed steel hinder domain wall motion during AC magnetization, further degrading the magnetic properties. As noted above, the crystallographic texture of the finished strip, that is, the distribution of the orientations of the crystal grains comprising the electrical steel strip, is very important in determining the core loss and magnetic permeability. The <100>and <110>texture components as defined by Millers indices have the highest magnetic permeability; conversely, the <111>type texture component has the lowest magnetic permeability.

Non-oriented electrical steels are generally provided in two forms, commonly referred to as "semi-processed" or "fully-processed" steels. "Semi-processed" infers the product must be annealed before use to develop the proper grain size and texture, relieve fabrication stresses and, if needed, provide appropriately low carbon levels to avoid aging. "Fully-processed" infers that the magnetic properties have been fully developed prior to the fabrication of the strip into laminations, that is, the grain size and texture have been established and the carbon content has been reduced to about 0.003% or less to prevent magnetic aging. These grades do not require annealing after fabrication into laminations unless so desired to relieve fabrication stresses. Non-oriented electrical steels are predominantly used in rotating devices, such as motors or generators, where uniform magnetic properties are desired in all directions with respect to the strip rolling direction, or where the cost of a grain oriented electrical steel is not justified.

Non-oriented electrical steels differ from grain oriented electrical steels since grain oriented electrical steels are processed so as to develop a preferred orientation by a process known as secondary grain growth (or secondary recrystallization). Secondary grain growth results in the electrical steel having extremely directional magnetic properties with respect to the strip rolling direction, making grain oriented electrical steels suitable for applications where directional properties are desired, such as in transformers.

Commercially available non-oriented electrical steels are typically broken into two classifications: cold rolled motor lamination steels ("CRML") and cold rolled non-oriented electrical steels ("CRNO"). CRML is generally used in applications where the requirement for very low core losses is difficult to justify economically. Such applications typically require that the non-oriented electrical steel have a maximum core loss of about 4 W/# (watts/pound) (about 8.8 watts/kg) and a minimum magnetic permeability of about 1500 G/Oe (Gauss/Oersted) measured at 1.5T and 60 Hz. In such applications, the steel strip used is typically processed to a nominal thickness of about 0.018 inch (about 0.45 mm) to about 0.030 inch (about 0.76 mm). CRNO is generally used in more demanding applications where better magnetic properties are required. Such applications typically require that the non-oriented electrical steel has a maximum core loss of about 2 W/# (about 4.4 W/kg) and a minimum magnetic permeability of about 2000 G/Oe measured at 1.5T and 60 Hz. In such applications, the steel strip is typically processed to a nominal thickness of about 0.008 inch (about 0.20 mm) to about 0.025 inch (about 0.63 mm).

None of the previous methods teach or suggest the method of the present invention in which the non-oriented electrical steel is made from a cast strip to meet the above mentioned magnetic property requirements in an economical manner.

STATEMENT OF THE INVENTION

The present invention discloses methods for producing non-oriented electrical steels from a thin cast strip.

All discussions in the present patent application relating to alloy composition percentages (%) are expressed in terms of weight percent unless otherwise noted.

The present invention provides for a steel having a composition in which the silicon, aluminum, chromium, manganese and carbon contents are as follows:

i. Silicon: up to about 6.5%
ii. Aluminum: up to about 3%
iii. Chromium: up to about 5%
iv. Manganese: up to about 3%
v. Carbon: up to about 0.05%;

In addition, the steel may have antimony in an amount up to about 0.15%;

niobium in an amount up to about 0.005%; nitrogen in an amount up to about 0.01%; phosphorus in an amount up to about 0.25%; sulfur and/or selenium in an amount up to about 0.01%; tin in an amount up to about 0.15%; titanium in an amount up to about 0.005%; and vanadium in an amount up to about 0.005% with the balance being iron and residuals incidental to the method of steel making.

In a preferred composition, these elements are present in the following amounts:

i. Silicon: about 1% to about 3.5%;
ii. Aluminum: up to about 0.5%;
iii. Chromium: about 0.1% to about 3%;
iv. Manganese: about 0.1% to about 1%;
v. Carbon: up to about 0.01%;
vi. Sulfur: up to about 0.01%;
vii. Selenium: up to about 0.01%; and
viii. Nitrogen: up to about 0.005%;

In a more preferred composition, these elements are present in the following amounts:

i. Silicon: about 1.5% to about 3%;
ii. Aluminum: up to about 0.05%;
iii. Chromium: about 0.15% to about 2%;
iv. Manganese: about 0.1% to about 0.35%;
v. Carbon: up to about 0.005%;
vi. Sulfur: up to about 0.005%;
vii. Selenium: up to about 0.007%; and
viii. Nitrogen: up to about 0.002%.

In one embodiment, the present invention provides a method to produce a non-oriented electrical steel with relatively uniform magnetic properties in all strip directions from a steel melt containing silicon and other alloying additions or impurities incidental to the method of steelmaking which is subsequently cast into a thin strip having a thickness of about 0.40 inch (about 10 mm) or less and, preferably, less than about 0.16 inch (about 4 mm), cooled and hot reduced in a manner to minimize the recrystallization of the as-cast grain structure in the hot rolled strip prior to finish annealing.

The non-oriented electrical steel of this method can be used without the additional annealing or cold rolling treatments prior to the finish annealing treatment to develop the desired magnetic characteristics for use in a motor, transformer or like device.

In a second embodiment, the present invention provides a method whereby a non-oriented electrical steel with relatively uniform magnetic properties in all strip directions is produced from a steel melt containing silicon and other alloying additions or impurities incidental to the method of steelmaking which is cast into a thin strip having a thickness of about 0.40 inch (about 10 mm) or less and, preferably, less than about 0.16 inch (about 4 mm), cooled, cold rolled and finish annealed to develop the desired magnetic characteristics for use in a motor, transformer or like device.

In a third embodiment, the present invention provides a method whereby a non-oriented electrical steel with relatively uniform magnetic properties in all strip directions is produced from a steel melt containing silicon and other alloying additions or impurities incidental to the method of steelmaking which is cast into a thin strip having a thickness of about 0.40 inch (about 10 mm) or less and, preferably, less than about 0.16 inch (about 4 mm), which is hot reduced in a manner to minimize recrystallization of the as-cast grain structure, cold rolled and finish annealed to develop the desired magnetic characteristics for use in a motor, transformer or a like device.

In the preferred practice of the above embodiments, the steel melt contains silicon, chromium, manganese and like additions; the steel melt is cast into a thin strip having a thickness of between about 0.06 inch (about 1.5 mm) and about 0.16 inch (about 4 mm); the cast strip is rapidly cooled in a manner to preserve the as-cast grain structure and/or is hot rolled to minimize recrystallization of the as-cast grain structure in the hot rolled strip.

Unless otherwise defined, all technical and scientific terms used herein have the same meaning as commonly understood by one of ordinary skill in the art. Although methods and materials similar or equivalent to those described herein can be used in the practice or testing of the present invention, suitable methods and materials are described below. All publications, patent applications, patents, and other references mentioned herein are incorporated by reference in their entirety. In the case of conflict, the present specification, including definitions, will control. In addition, the materials, methods, and examples are illustrative only and not intended to be limiting. Other features and advantages of the invention will be apparent from the following detailed description and claims.

DETAILED DESCRIPTION OF THE INVENTION

Figure 1:
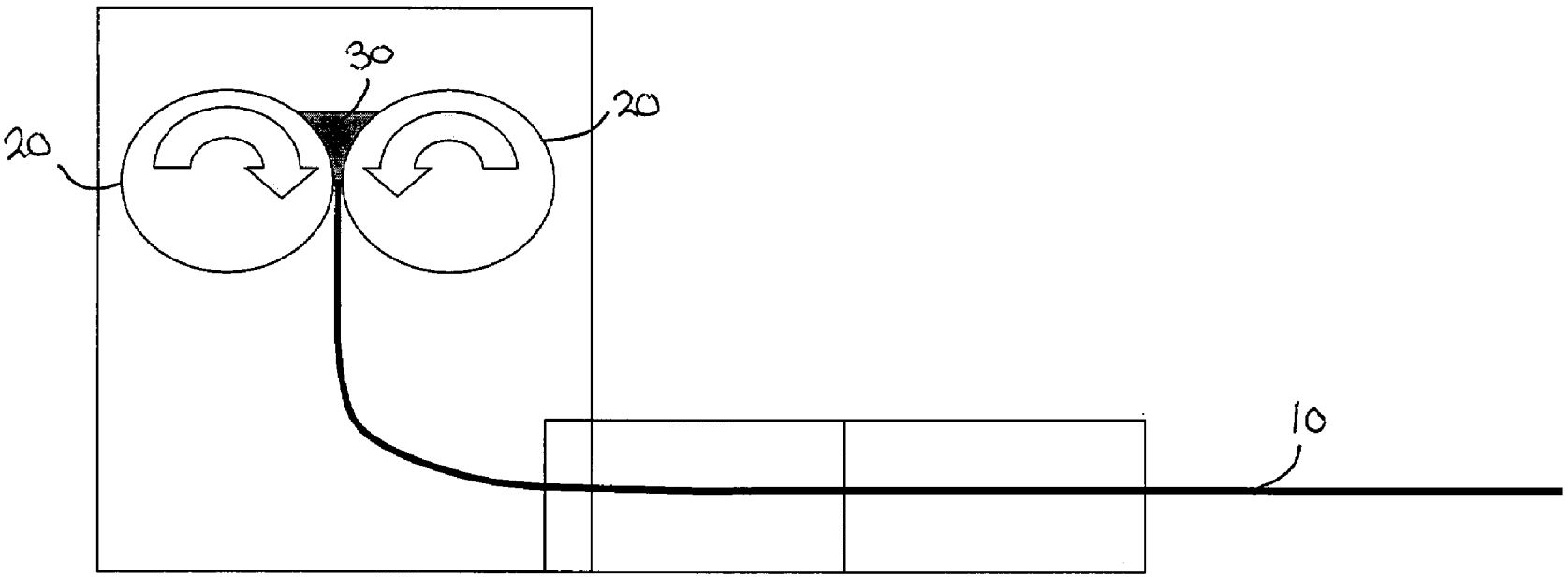
FIG. 1 is a schematic diagram of the generalized strip casting method.

In order to provide a clear and consistent understanding of the specification and claims, including the scope to be given such terms, the following definitions are provided.

The terms "ferrite" and "austenite" are used to describe the specific crystalline forms of steel. "Ferrite" or "ferritic steel" has a body-centered-cubic, or "bcc", crystalline form whereas "austenite" or "austenitic steel" has a face-centered cubic, or "fcc", crystalline form. The term "fully ferritic steel" is used to describe steels that do not undergo any phase transformation between the ferrite and austenite crystalline forms in the course of cooling from the melt and/or in reheating for hot rolling, regardless of its final room temperature microstructure.

The terms "strip" and "sheet" are used to describe the physical characteristics of the steel in the specification and claims being comprised of a steel being of a thickness of less than about 0.4 inch (about 10 mm) and of a width typically in excess of about 10 inches (about 250 mm) and more typically in excess of about 40 inches (about 1000 mm). The term "Strip" has no width limitation but has a substantially greater width than thickness.

For purposes of clarity, the initial cooling rate will be considered to be the rate of cooling of the molten metal provided by the casting roll or rolls. The term secondary cooling rate will be considered to be the cooling rate of the strip after exiting from the casting roll or rolls.

The term "rolls" as used herein refers to single or paired rolls, drums or belts. Generally, pairs of rolls are used that are internally cooled and rotating in the opposite direction of each other and disposed parallel to each other with their axes generally held horizontal.

The present invention provides for a non-oriented electrical steel with low core loss and high magnetic permeability which is produced from a rapidly solidified and cast strip, the cast strip having a thickness of less than about 0.8 inch (about 20 mm), typically having a thickness of less than about 0.4 inch (about 10 mm), and preferably having a thickness of less than about 0.16 inch (about 4 mm). This rapid solidification process typically uses two counter-rotating casting rolls or belts, but a single cooling roll or belt may also be employed.

The technical requirements for applying direct thin strip casting to the production of non-oriented electrical steel differ from stainless steels and carbon steels due to the metallurgical characteristics, i.e., composition, precipitates and inclusions, texture and grain growth, needed to achieve the desired magnetic properties in the finished annealed non-oriented electrical steel. In the present process for producing a non-oriented electrical steel strip, the starting cast strip is produced by a rapid quench-solidification process whereby a steel melt can be solidified into a strip form using either a single roll (or drum), two counter-rotating casting rolls (or belts or drums) or a continuous belt. Preferably, the strip is cast between two closely spaced horizontal rolls rotated in opposite directions and cooled internally.

In the practice of the method of the present invention, a thin cast strip having a thickness of about 0.03 inch (about 0.7 mm) to about 0.16 inch (about 4.0 mm) is preferred. Strip casting apparatuses and methods are known in the art, e.g., U.S. Pat. Nos. 6,257,315; 6,237,673; 6,164,366; 6,152,210; 6,129,136; 6,032,722; 5,983,981; 5,924,476; 5,871,039; 5,816,311; 5,810,070; 5,720,335; 5,477,911; 5,049,204, all of which are specifically incorporated herein by reference.

FIG. 1 depicts a schematic diagram of the generalized twin-roll, strip casting method. The steel melt forms a melt pool 30 that is rapidly solidified using two counter-rotating casting rolls 20 (or belts or drums) to form a thin cast strip 10. Generally, the casting rolls 20 are internally cooled.

In the practice of the present invention, a steel melt containing alloying additions of silicon, chromium, manganese, aluminum and phosphorus is employed. The primary purpose of these additions is to increase volume resistivity as Equation I shows and, thereby, lower core loss caused by eddy currents which are induced during AC magnetization:

$$\rho=13+6.25(\%\ Mn)+10.52(\%\ Si)+11.82(\%\ Al)+6.5(\%\ Cr)+14(\%\ P) \quad (I)$$

where $\rho$ is the volume resistivity, in $\mu\Omega$-cm, of the steel and % Mn, % Si, % Al, % Cr and % P are, respectively, the weight percentages of manganese, silicon, aluminum, chromium and phosphorus in the steel.

The resultant thin cast strip is processed to a final thickness by means of hot rolling where the finished steel is to have magnetic properties typical of a CRML grade of non-oriented electrical steel made using conventional methods; or by cold rolling or, optionally, hot and cold rolling, where the finished steel is to have magnetic properties comparable to CRML or CRNO grades of non-oriented electrical steel made using conventional methods.

To begin to make the electrical steels of the present invention, a steel melt may be produced using the generally established methods of steel melting, refining and alloying. The melt composition comprises generally up to about 6.5% silicon, up to about 3% aluminum, up to about 5% chromium, up to about 3% manganese, up to about 0.01% nitrogen, and up to about 0.05% carbon with the balance being essentially iron and residual elements incidental to the method of steelmaking. A preferred composition comprises from about 1% to about 3.5% silicon, up to about 0.5% aluminum, about 0.1% to about 3% chromium, about 0.1% to about 1% manganese, up to about 0.01% sulfur and/or selenium, up to about 0.005% nitrogen and up to about 0.01% carbon. In addition, the preferred steel may have residual amounts of elements, such as titanium, niobium and/or vanadium, in amounts not to exceed about 0.005%. A more preferred steel comprises about 1.5% to about 3% silicon, up to about 0.05% aluminum, about 0.15% to about 2% chromium, up to about 0.005% carbon, up to about 0.008% sulfur or selenium, up to about 0.002% nitrogen, about 0.1% to about 0.35% manganese and the balance iron with normally occurring residuals.

The steel may also include other elements such as antimony, arsenic, bismuth, phosphorus and/or tin in amounts up to about 0.15%. The steel may also include copper, molybdenum and/or nickel in amounts up to about 1% individually or in combination. Other elements may be present either as deliberate additions or present as residual elements, i.e., impurities, from steel melting process. Exemplary methods for preparing the steel melt include oxygen, electric arc (EAF) or vacuum induction melting (VIM). Exemplary methods for further refining and/or making alloy additions to the steel melt may include a ladle metallurgy furnace (LMF), vacuum oxygen decarburization (VOD) vessel and/or argon oxygen decarburization (AOD) reactor.

Silicon is present in the steels of the present invention in an amount of about 0.5% to about 6.5% and, preferably, about 1% to about 3.5% and, more preferably, about 1.5% to about 3%. Silicon additions serve to increase volume resistivity, stabilize the ferrite phase and increase hardness for improved punching characteristics in the finished strip; however, at levels above about 2.5%, silicon is known that make the steel more brittle.

Chromium is present in the steels of the present invention in an amount of up to about 5% and, preferably, about 0.1% to about 3% and, more preferably, about 0.15% to about 2%. Chromium additions serve to increase volume resistivity; however, its effect must be considered in order to maintain the desired phase balance and microstructural characteristics.

Manganese is present in the steels of the present invention in an amount of up to about 3% and, preferably, about 0.1% to about 1% and, more preferably, about 0.1% to about 0.35%. Manganese additions serve to increase volume resistivity; however, its effect must be considered in order to maintain the desired phase balance and microstructural characteristics.

Aluminum is present in the steels of the present invention in an amount of up to about 3% and, preferably, up to about 0.5% and, more preferably, up to about 0.05%. Aluminum additions serve to increase volume resistivity, stabilize the ferrite phase and increase hardness for improved punching characteristics in the finished strip; however, aluminum can combine with other elements to form precipitates during cooling after solidification which may hinder grain growth during processing.

Sulfur and selenium are undesirable elements in the steels of the present invention in that these elements can combine with other elements to form precipitates that may hinder grain growth during processing. Sulfur is a common residual in steel melting. Sulfur and/or selenium, when present in the steels of the present invention, may be in an amount of up to about 0.01%. Preferably sulfur may be present in an amount up to about 0.005% and selenium in an amount up to about 0.007%.

Nitrogen is an undesirable element in the steels of the present invention in that nitrogen can combine with other elements and form precipitates that may hinder grain growth during processing. Nitrogen is a common residual in steel melting and, when present in the steels of the present invention, may be in an amount of up to about 0.01% and, preferably, up to about 0.005% and, more preferably, up to about 0.002%.

Carbon is an undesirable element in the steels of the present invention. Carbon fosters the formation of austenite and, when present in an amount greater than about 0.003%, the steel must be provided with a decarburizing annealing treatment to reduce the carbon level sufficiently to prevent "magnetic aging", caused by carbide precipitation, in the finish annealed steel. Carbon is a common residual from steel melting and, when present in the steels of the present invention, may be in an amount of up to about 0.05% and, preferably, up to about 0.01% and, more preferably, up to about 0.005%. If the melt carbon level is greater than about 0.003%, the non-oriented electrical steel must be decarburization annealed to less than about 0.003% carbon and, preferably, less than about 0.0025% so that the finished annealed strip will not magnetically age.

Strip products from non-oriented electrical steel of the present invention are subjected during manufacturing to rolling processes such as hot rolling and/or cold rolling in which the strip undergoes a reduction in the thickness.

The cast and rolled strip is further provided with a finishing anneal within which the desired magnetic properties are developed and, if necessary, to lower the carbon content sufficiently to prevent magnetic aging. The finishing annealing is typically conducted in a controlled atmosphere during annealing, such as a mixed gas of hydrogen and nitrogen. There are several methods well known in the art, including batch or box annealing, continuous strip annealing, and induction annealing. Batch annealing, if used, is typically conducted to provide an annealing temperature of at or above about 1450° F. (about 790° C.) and less than about 1550° F. (about 843° C.) for a time of approximately one hour as described in ASTM specifications 726-00, A683-98a and A683-99. Continuous strip annealing, if used, is typically conducted at an annealing temperature at or above 1450° F. (about 790° C.) and less than about 1950° F. (about 1065° C.) for a time of less than ten minutes. Induction annealing, when used, is typically conducted to provide an annealing temperature greater than about 1500° F. (815° C.) for a time less than about five minutes.

In the practice of the method of the present invention, the temperature of the non-oriented electrical steel strip leaving the casting roll surface is generally higher than about 2500° F. (about 1370° C.). The non-oriented electrical steel may be processed whereby the cast strip is provided with secondary cooling from a temperature of less than about 2500° F. (about 1370° C.) to a temperature less than about 1700° F. (about 925° C.) at a rate greater than about 20° F. per second (about 10° C. per second). The non-oriented electrical steel may be cooled and the cast, solidified and cooled strip may be coiled at a temperature less than about 1475° F. (about 800° C.).

The cooling process may be optionally conducted in a protective non-oxidizing atmosphere to reduce or prevent oxidation of the surfaces of the steel strip.

The present invention also provides for a steel melt cast into a starting strip wherein the cast strip is subjected to rapid cooling to maintain the as-cast ferritic microstructure.

In the preferred method of the invention, the cast strip is further provided with rapid secondary cooling from a temperature greater than about 2280° F. (about 1250° C.) to a temperature less than about 1650° F. (about 900° C.) at a rate greater than about 45° F. per second (about 25° C. per second). This rapid secondary cooling process is typically accomplished using water spray or air-water mist cooling. A more preferred rate for the rapid secondary cooling of the present invention is greater than about 90° F. per second (about 50° C. per second) and a most preferred rate is greater than about 120° F. per second (about 65° C. per second). The cooling conditions for the steel strip may be controlled using a sprayer system which comprises a spray nozzle design, spray angles, flow rate, spray water density, length of cooling zone and/or the number of spray nozzles. Since it is difficult to monitor the strip temperature during spray cooling due to the variations in water film thickness on the strip, water spray density measurements are typically used. A spray density of from about 125 liters per minute per m2 to about 450 liters per minute per $m^2$ generally provides the desired cooling rate. The cast, solidified and cooled strip may be coiled at a temperature less than about 1475° F. (about 800° C.) and, more preferably, less than about 1250° F. (about 680° C.).

The present invention provides for a non-oriented electrical steel having magnetic properties appropriate for commercial use wherein a steel melt is cast into a starting strip which is then processed by hot rolling, cold rolling or both prior to finish annealing to develop the desired magnetic properties.

In the practice of the method of the present invention, the non-oriented electrical steel strip may be processed using hot rolling, cold rolling, or a combination thereof. If hot rolling is used, the strip may be rolled from a temperature of from about 1300° F. (about 700° C.) to about 2000° F. (about 1100° C.). The rolled strip may be further provided with an annealing step to produce the desired crystal structure and microstructure of the steel, particularly in cases where the melt composition does not provide a fully ferritic microstructure and, more particularly, when processing conditions result in substantial recrystallization of the microstructure prior to cold rolling and/or finish annealing. However, the use of these process methods can lead to growth of an oxide scale on the steel surfaces. The use of suitable process methods commonly known in the art make it possible, within limits, to influence this oxide formation in respect to quality as well as quantity.

The silicon and chromium bearing non-oriented electrical steel of one embodiment of the present invention is advantageous as improved mechanical property characteristics of superior toughness and greater resistance to strip breakage during processing are obtained. In one embodiment, the present invention provides processes to produce a non-oriented electrical steel having magnetic properties which have a maximum core loss of about 4 W/# (about 8.8W/kg) and a minimum magnetic permeability of about 1500 G/Oe measured at 1.5T and 60 Hz.

In another embodiment, the present invention provides processes to produce a non-oriented electrical steel having magnetic properties which have a maximum core loss of about 2 W/# (about 4.4W/kg) and a minimum magnetic permeability of about 2000 G/Oe measured at 1.5T and 60 Hz.

In one embodiment of the non-oriented electrical steel of the present invention, a steel having a composition which is not fully ferritic can be employed wherein the rapid cooling during strip casting and/or appropriate downstream processing, such as rapid secondary cooling of the cast strip, hot rolling and annealing conditions, are employed in order to suppress the formation of the austenite phase.

In the optional practices of the present invention, the cast, solidified and cooled strip may be provided with a hot reduction and/or an annealing step prior to cold rolling and/or finish annealing. It is well known to those skilled in the art that processing a strip with a starting microstructure consisting of mixed phases of ferrite and austenite may provide significant difficulties in controlling the grain size and crystalline orientation, particularly, recrystallization may lead to the formation of a <111>orientation which has poorer magnetic properties than the preferred <100>and <110>orientations.

In the practice of the method of the present invention, the formation of the austenite phase can be prevented using a melt composition to provide a fully ferritic microstructure or, alternatively, by control of the processing conditions of the cast, solidified and cooled strip where the melt composition does not provide a fully ferritic microstructure. Equation II illustrates the effect of composition on formation of the austenite phase.

The percentages of the elements shown in Equation II are all in weight % while $T_{20\ wt\ \%\ \gamma}$ (noted in the Tables as $T_{20}$) is the temperature which, under equilibrium conditions, would provide for 20 weight % of the steel to be in the form of the austenite phase.

$$T_{20\ wt\ \%\gamma},\ ^\circ\text{C.} = 787.8 - 4407(\%C) - 151.6(\%Mn) + 564.7(\%P) + 155.9(\%Si) + 439.8(\%Al) - 50.7(\%Cr) - 68.8(\%N) - 53.2(\%Cu) - 139(\%Ni) + 88.3(\%Mo) \quad \text{(II)}$$

In the practice of the method of the present invention, Equation II can be used to determine the limiting temperature for hot rolling, if used, and/or annealing, if used, of the strip.

Hot rolling of the cast and solidified strip may be preferred for a number of reasons. First, a cast strip often has shrinkage porosity which must be closed to obtain the desired strip mechanical and magnetic properties. Second, textured casting rolls are commonly used for the direct casting of strip. In effect, the surface roughness of the as-cast strip reflects the surface roughness of the casting rolls, making the surface of a cast strip unsuitable for use in magnetic cores where the steel laminations must be assembled into a tightly packed stack. It has been established in the art that a thin cast strip can be hot rolled to provide the desired surface characteristics for both carbon steels and stainless steels. The applicants determined the application of hot rolling can substantially degrade the magnetic properties of the finished annealed non-oriented electrical steel; however, the applicants discovered the method of the present invention whereby hot rolling can be employed wherein the cast strip can be hot rolled, annealed, optionally cold rolled, and finish annealed to provide a non-oriented electrical steel having superior magnetic properties. The applicants have further determined in one embodiment of the present invention that a cast strip can be hot rolled, cold rolled and finish annealed to provide a non-oriented electrical steel having superior magnetic properties without requiring an annealing step after hot rolling.

In the research studies conducted by the applicants, the best magnetic properties can be obtained whereby the hot rolling conditions suppress recrystallization of the as-cast microstructure prior to cold rolling and/or finish annealing, thereby preserving the <.100>texture characteristic of the as-cast strip. In one embodiment of the methods of the present invention, the deformation conditions for hot rolling were modeled to determine the requirements for hot deformation whereby the strain energy imparted from hot rolling was insufficient to allow extensive recrystallization of the cast strip. This model, outlined in Equations III through IX, represents a further embodiment of the method of the present invention and should be readily understood by one skilled in the art.

The strain energy imparted from rolling can be calculated as:

$$W = \theta_c \ln\left(\frac{1}{1-R}\right) \quad \text{(III)}$$

Whereby W is the work expended in rolling, $\theta_c$ is the constrained yield strength of the steel and R is the amount of reduction taken in rolling in decimal fraction, i.e., initial thickness of the cast strip ($t_c$, in mm) divided by the final thickness of the cast and hot rolled strip ($t_f$, in mm). The true strain in hot rolling can be further calculated as:

$$\epsilon = K_1 W \quad \text{(IV)}$$

Where $\epsilon$ is the true strain and $K_1$ is a constant. Combining Equation III into Equation IV, the true strain can be calculated as:

$$\varepsilon = K_1 \theta_c \ln\left(\frac{t_c}{t_f}\right) \quad \text{(V)}$$

The constrained yield strength, $\theta_c$, is related to the yield strength of the cast steel strip when hot rolling. In hot rolling, recovery occurs dynamically and thus strain hardening during hot rolling is considered not to occur in the method of the invention. However, the yield strength depends markedly on temperature and strain rate and thereby the applicants incorporated a solution based on the Zener-Holloman relationship whereby the yield strength is calculated based on the temperature of deformation and the rate of deformation, also termed as the strain rate, as follows.

$$\theta_T = 4.019\,\dot{\varepsilon}^{0.15} \exp\left(\frac{7616}{T}\right) \quad \text{(VI)}$$

Where $\theta_T$ is the temperature and strain rate compensated yield strength of the steel during rolling, $\dot{\epsilon}$ is the strain rate of rolling and T is the temperature, in ° K, of the steel when rolled. For the purposes of the present invention, $\theta_T$ is substituted for $\theta_c$ in Equation V to obtain:

$$\varepsilon = K_2 \dot{\varepsilon}^{0.15} \exp\left(\frac{7616}{T}\right) \ln\left(\frac{t_c}{t_f}\right) \quad \text{(VII)}$$

Where $K_2$ is a constant.

A simplified method to calculate the mean strain rate, $\dot{\epsilon}_m$, in hot rolling is shown in Equation VIII:

$$\dot{\varepsilon}_m = K_3 \frac{2\pi D n}{\sqrt{D t_c}} \sqrt{\frac{t_c - t_f}{t_c}} \left[1 + \frac{1}{4}\left(\frac{t_c - t_f}{t_c}\right)\right] \quad \text{(VIII)}$$

Where D is the work roll diameter in mm, n is the roll rotational rate in revolutions per second and $K_3$ is a constant. The above expressions can be rearranged and simplified by substituting $\dot{\epsilon}_m$ of Equation VIII for $\dot{\epsilon}$ of Equation VII and assigning a value of 1 to the constants, $K_1$, $K_2$ and $K_3$, whereby the nominal hot rolling strain, $\epsilon_{nominal}$, can be calculated as shown in Equation IX:

$$\varepsilon_{nominal} = \left[\frac{2\pi n}{t_c}\sqrt{D(t_c - t_f)}\left(1.25 - \frac{t_f}{4t_f}\right)\right]^{0.15} \exp\left(\frac{7616}{T}\right) \ln\left(\frac{t_c}{t_f}\right) \quad \text{(IX)}$$

In one preferred practice of the method of the present invention, the conditions used for hot rolling have been found to be critical to achieving the desired magnetic properties in the strip.

Figure 7:
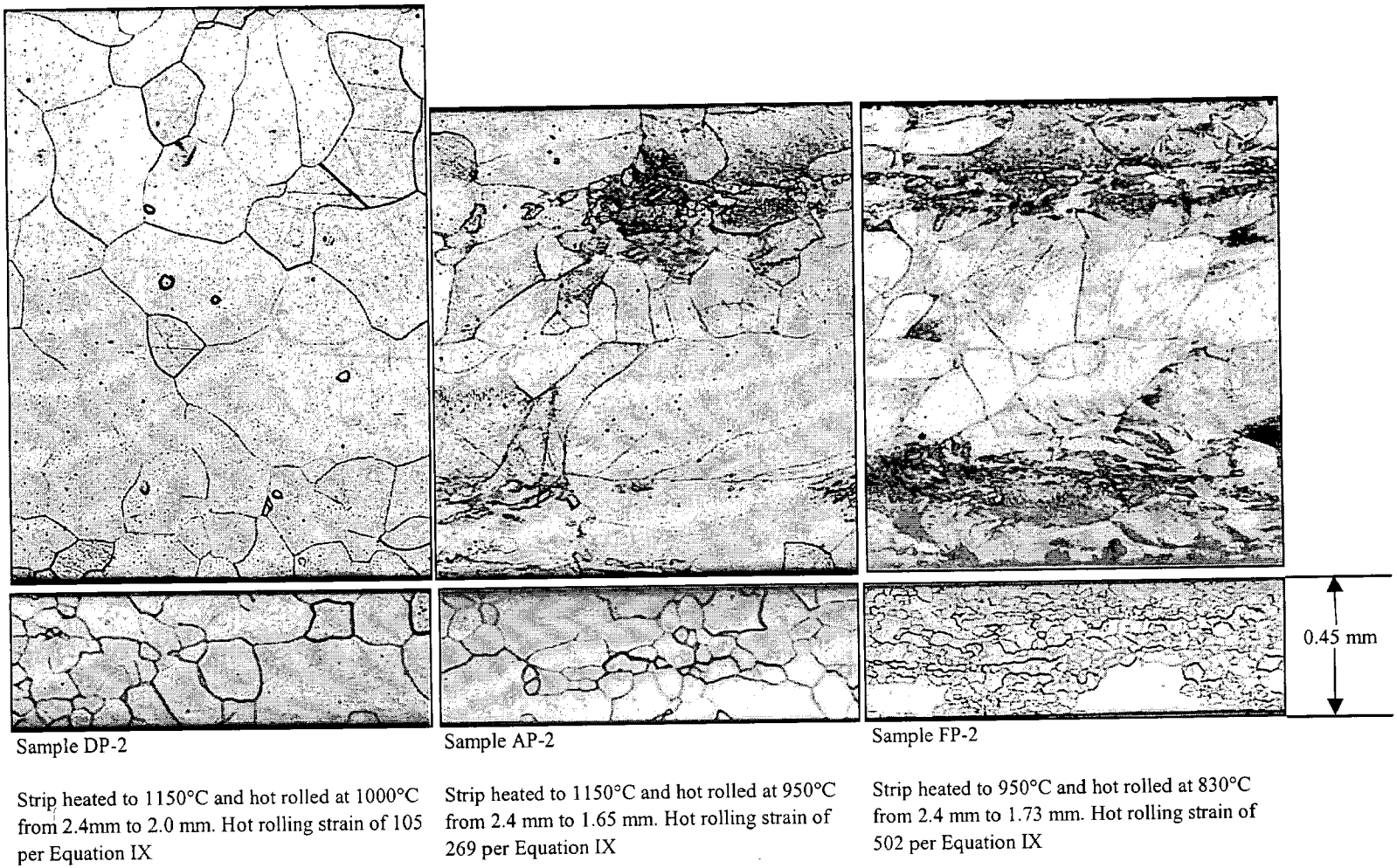
FIG. 7 shows typical microstructures taken at 50× magnification after hot rolling and after further cold rolling to about 0.018" (about 0.45 mm) and finish annealing at a temperature of about 1450° F. (about 790° C.) of a non-oriented electrical steel of the preferred method of the present invention having a volume resistivity of about 50 $\mu\Omega$-cm.
Figure 8:
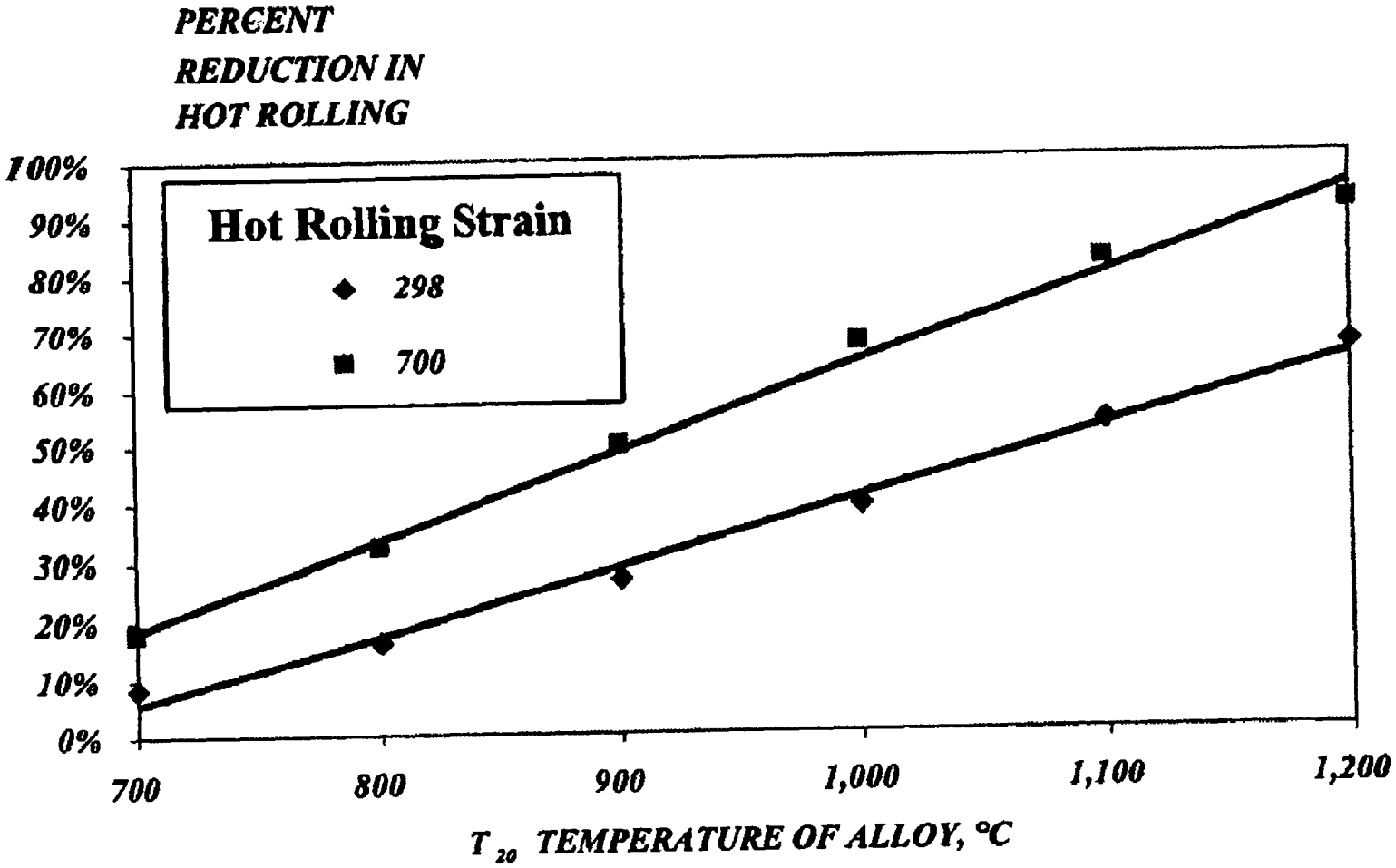
FIG. 8 is a graph depicting the effect of composition, expressed in terms of $T_{20\ wt\ \%\ \gamma}$ hot rolling temperature and % reduction in hot rolling to provide a specific level of hot rolling strain.

In the practice of the method of the present invention, there are practical issues that arise from the use of thin strip casting to produce non-oriented electrical steels which conditions are well known to commonly exist. A thin cast steel strip may have significant amounts of centerline porosity that results from solidification shrinkage along the centerline of the strip that must be closed using some amount of hot or cold rolling. In the preferred embodiments of the present invention, the cast strip is hot or cold rolled with a sufficient reduction in thickness to fully close the porosity. Second, twin-roll type strip casters commonly use casting drums or rolls that have an engineered roll surface design. Typically the roll surface is roughened to control heat transfer during solidification and thereby produce a strip free of cracking after casting. In the practice of the present invention, the cast strip must be hot or cold rolled with sufficient reduction in thickness to smooth the surface of the strip and provide a non-oriented electrical steel strip acceptable for practical use. Moreover, in the more preferred embodiments of the present invention, the hot rolling step, if used, must be performed under conditions that preclude the formation of the austenite phase or an excessive amount of strain imparted by hot rolling. FIG. 7 shows the effect of the hot rolling strain on the recrystallized grain size in non-oriented steel of the present invention. In the more preferred embodiments of the present invention, a non-oriented electrical steel strip having a large recrystallized grain size after finish annealing can be produced. FIG. 8 shows how the amount of reduction and rolling temperature can be used for steel of the method of the present invention having a wide range of $T_{20\ wt\ \%\ \gamma}$. FIG. 8 further illustrates that the amount of hot rolling strain determines whether the non-oriented steel can be produced without an annealing of the hot rolled strip prior to cold rolling and finish annealing and/or wherein said finishing annealing step uses a lengthy and/or higher annealing temperatures.

In the optional method whereby the cast strip is subjected to one or more hot rolling steps, a reduction in thickness of greater than at least about 10% and less than about 75%, preferably, greater than about 20% and less than about 70%, more preferably, greater than about 30% and less than about 65%. According to the preferred method of the present invention, the thin cast strip is hot rolled at a temperature at or less than $T_{20\ wt\ \%\ \gamma}$ of Equation II to avoid producing a transformation of the ferrite phase established from the rapid cooling of casting and secondary cooling to the austenite phase. The conditions of the hot rolling step, including the specific deformation temperature, specific reduction and specific rate of reduction are further specified to minimize the amount of recrystallization in the strip prior to cold rolling or finish annealing of the strip. In the method of the present invention, the non-oriented electrical steel is desired to have less than about 25% of the strip thickness undergo such recrystallization. In the preferred practice of the method of the present invention, less than about 15% of the strip thickness is desired to undergo such recrystallization. In the more preferred practice of the method of the present invention, less than about 10% of the strip thickness is desired to undergo such recrystallization. In the most preferred practice of the method of the present invention, the strip is substantially free of recrystallization.

In the practice of the present invention, annealing of the cast and hot rolled strip may be carried out by means of self-annealing in which the hot rolled strip is annealed by the heat retained therein. Self-annealing may be obtained by coiling the hot rolled strip at a temperature above about 1300° F. (about 705° C.). Annealing of the cast and hot rolled strip may also be conducted using either batch type coil anneal or continuous type strip anneal methods which are well known in the art. Using a batch type coil anneal, the hot rolled strip is heated to an elevated temperature, typically greater than about 1300° F. (about 705° C.) for a time greater than about 10 minutes, preferably greater than about 1400° F. (about 760° C.). Using a strip type continuous anneal, the hot rolled strip is heated to a temperature typically greater than about 1450° F. (about 790° C.) for a time less than about 10 minutes.

A cast strip, a cast and hot rolled strip, or a cast and hot rolled and hot band annealed strip of the present invention may optionally be subjected to a descaling treatment to remove any oxide or scale layer formed on the non-oriented electrical steel strip before cold rolling or finish annealing. "Pickling" is the most common method of descaling where the strip is subjected to a chemical cleaning of the surface of a metal by employing aqueous solutions of one or more inorganic acids. Other methods such as caustic, electrochemical and mechanical cleaning are established methods for cleaning the steel surface.

After finish annealing, the steel of the present invention may be further provided with an applied insulative coating such as those specified for use on non-oriented electrical steels in ASTM specifications A677 and A976–97.

EXAMPLES OF THE INVENTION

Example 1

Figure 2:
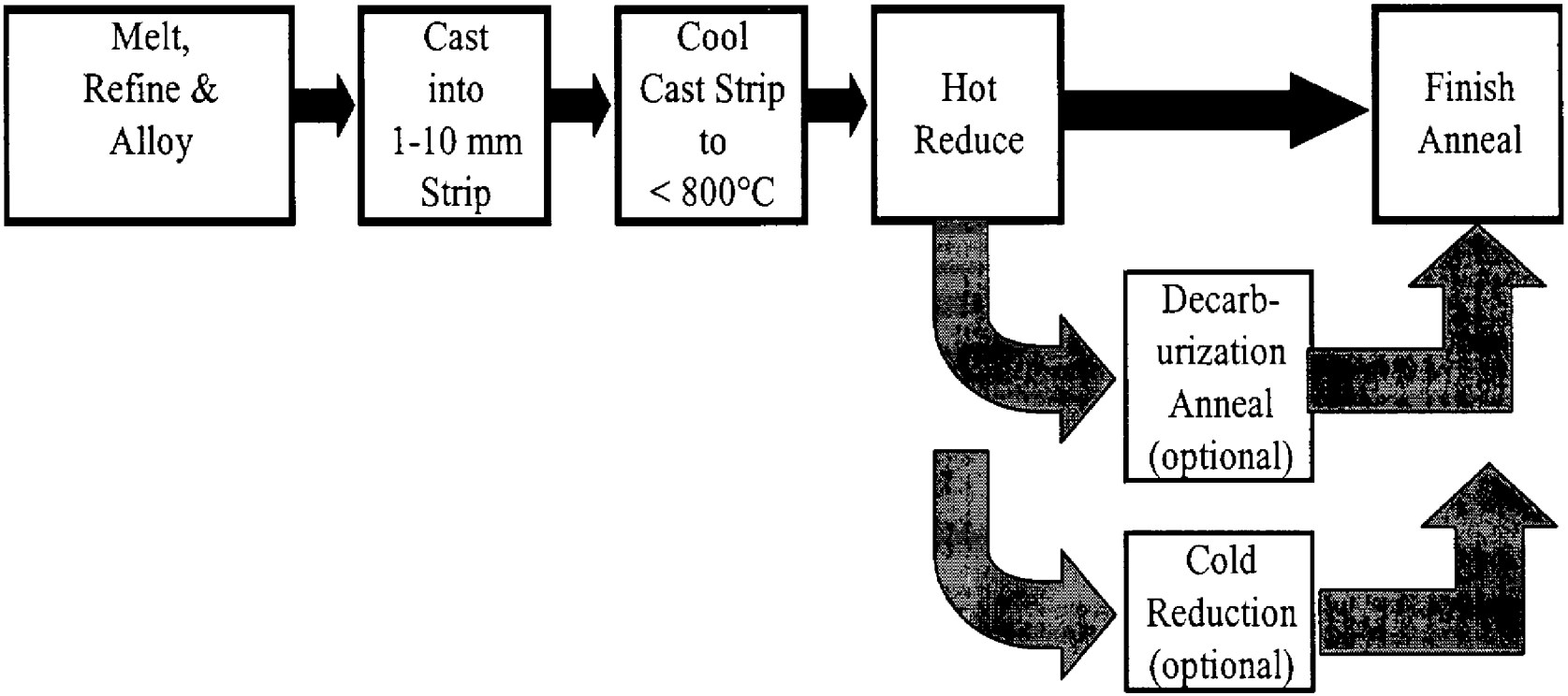
FIG. 2 is a flow diagram on the process of the first embodiment of the present invention.

Heats A and B having the compositions shown in Table I were melted, cast into strips having a thickness of about 0.10 inch (about 2.5 mm) and processed as exemplified in FIG. 2. Cast strips from Melts A having a thickness of about 0.10 inch (about 2.5 mm) and cast strips of Heat B having a thickness of about 0.10 inch (about 2.5 mm), about 0.060 inch (about 1.5 mm) and about 0.045 inch (about 1.15 mm) were provided with a hot reduction of about 30% to about 65% to a thickness of less than 0.040" (about 1 mm), the hot reduction made in a single rolling pass using about 9.5 inch (about 24 mm) diameter work rolls and a rolling speed of about 32 RPM, from a temperature below $T_{20}$ as defined in Equation II. The cast and hot rolled strips were descaled, sheared into test samples and final annealed in a batch anneal at about 1550° F. (about 843° C.) for a soak time of about 60 minutes in an atmosphere of 80% nitrogen and 20% hydrogen with a dew point of about 75° F. (about 25° C.), or, alternatively, the cast and hot rolled strips were descaled and provided with a cold reduction of from about 7% to about 23%, made in a single cold rolling pass, sheared into test samples and finish annealed in a batch anneal at about 1550° F. (about 843° C.) for a soak time of about 60 minutes in an atmosphere of 80% nitrogen and 20% hydrogen with a dew point of about 75° F. (about 25° C.). After finish annealing, the magnetic properties were measured both parallel and transverse to the strip rolling directions as shown in Table II.

TABLE I

| | Melt Composition in Weight % | | | | | | | | | | | | | | | |
|---|---|---|---|---|---|---|---|---|---|---|---|---|---|---|---|---|
| ID | C | Mn | P | S | Si | Cr | Ni | Mo | Cu | Sn | Ti | Al | N | O | $T_{20}$, ° C. | ρ |
| A | .0023 | .16 | .052 | .0013 | 1.72 | .12 | .081 | .028 | .090 | .025 | .003 | .38 | .0030 | .001 | 1198 | 38.1 |
| B | .0030 | .14 | .043 | .0009 | 1.77 | .29 | .089 | .027 | .084 | .025 | .003 | <.003 | .0037 | .003 | 1024 | 34.9 |
| C | .0044 | .16 | .058 | .0006 | 1.92 | .34 | .091 | .031 | .088 | .027 | .003 | <.003 | .0020 | .004 | 1088 | 37.3 |
| D | .0021 | .16 | .005 | .0011 | 2.75 | .08 | .081 | .029 | .095 | .003 | .003 | .61 | .0039 | .001 | 1436 | 50.8 |
| E | .0023 | .15 | .003 | .0010 | 2.55 | 1.46 | .091 | .036 | .094 | — | .003 | <.003 | .0032 | .004 | 1065 | 50.3 |

Notes:
(1) ρ from Equation I, μohm-cm
(2) $T_{20}$ from Equation II, ° C.

TABLE II

| | Summary of Magnetic Properties at 1.5 T and 60 Hz | | | | | | | | | |
|---|---|---|---|---|---|---|---|---|---|---|
| | | | | | Parallel to Strip Rolling Direction | | Transverse to Strip Rolling Direction | | 50/50 Direction | |
| Melt | Starting Thickness of Cast Strip, mm | Hot Rolling Reduction, % | Cold Rolling Reduction, % | Final Thickness, mm | Core Loss at 1.5 T 60 Hz, w/kg | Magnetic Permeability at 1.5 T | Core Loss at 1.5 T 60 Hz, w/kg | Magnetic Permeability at 1.5 T | Core Loss at 1.5 T 60 Hz, w/kg | Magnetic Permeability at 1.5 T |
| After 1550° F. Batch Anneal (844° C.) | | | | | | | | | | |
| B | 2.5 | 64% | — | 0.92 | 8.71 | 1867 | 8.93 | 1531 | 8.80 | 1733 |
| A | 2.5 | 64% | — | 0.90 | 8.29 | 2330 | 8.53 | 1698 | 8.39 | 2077 |
| B | 1.5 | 39% | — | 0.94 | 10.27 | 1415 | 10.12 | 1293 | 10.21 | 1366 |
| B | 1.1 | 30% | — | 0.80 | 8.38 | 1317 | 8.47 | 1188 | 8.41 | 1265 |
| After Cold Rolling and 1550° F. Batch Anneal (845° C.) | | | | | | | | | | |
| B | 2.5 | 64% | 13% | 0.80 | 7.36 | 1764 | 7.45 | 1519 | 7.40 | 1666 |
| A | 2.5 | 64% | 23% | 0.70 | 6.55 | 1947 | 6.72 | 1516 | 6.62 | 1775 |
| B | 1.5 | 39% | 17% | 0.77 | 7.52 | 1939 | 6.35 | 1304 | 7.05 | 1685 |
| B | 1.1 | 30% | 7% | 0.75 | 6.53 | 1717 | 6.75 | 1645 | 6.61 | 1688 |

As Table II shows, the practice of the present invention provided a non-oriented electrical steel with magnetic properties comparable to CRML grades made by generally accepted production methods, particularly when a small amount of cold reduction, also typical of the temper reductions commonly used in conventional manufacturing methods used for the production of CRML, is employed.

Example 2

Figure 3:
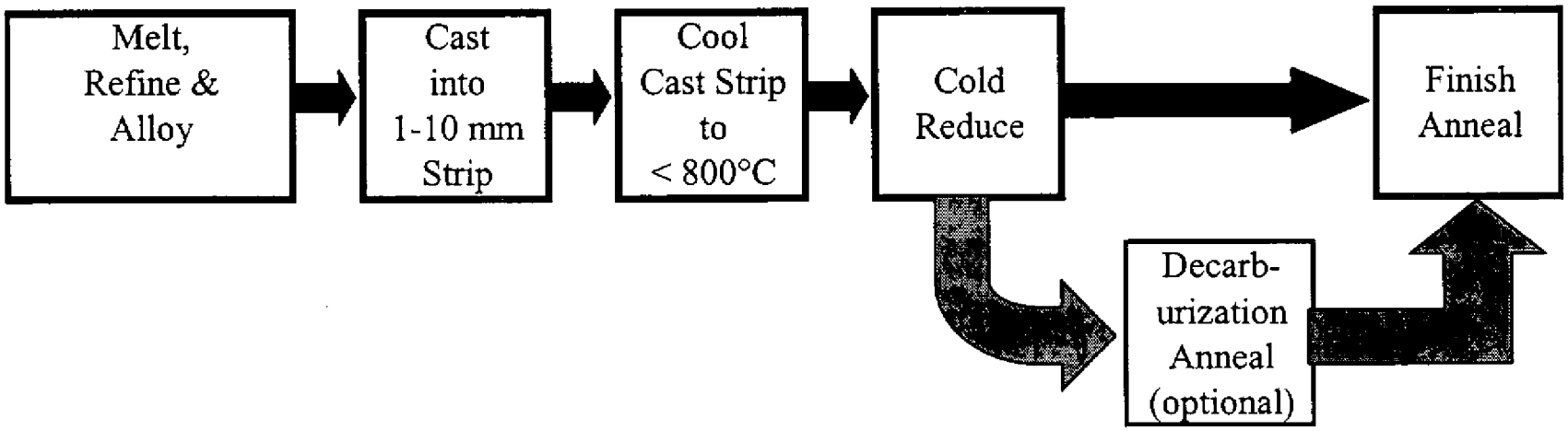
FIG. 3 is a flow diagram of the process of the second embodiment of the present invention.

Melts A and B of Example 1 were processed in a different embodiment of the method of the present invention whereby the cast strips were processed as exemplified in FIG. 3. As shown in Table I, the composition of Melts A and B provide a volume resistivity (ρ) calculated from Equation I representative of an intermediate-silicon non-oriented electrical steel of the art. The cast and solidified strips were subjected to rapid secondary cooling to a temperature below about 1000° F. (about 540° C.) in accordance with the preferred method of the present invention. The cast, solidified and cooled strips were cold rolled to a thickness of about 0.018 inch (about 0.45 mm). After cold rolling, the strips were finish annealed by batch annealing at a temperature of about 1550° F. (about 843° C.) for a soak time of about 60 minutes in an atmosphere of 80% nitrogen and 20% hydrogen with a dew point of about 75° F. (about 25° C.), or finish annealed as a continuous strip anneal at a temperature of either about 1450OF (about 790° C.) or about 1850° F. (about 1010° C.) for a soak time of less than about 60 seconds in an atmosphere of 75% nitrogen and 25% hydrogen with a dew point of about 95° F. (about 35° C.), sheared into test samples and subsequently batch annealed at about 1550° F. (about 843° C.). After batch annealing, the magnetic properties were measured in both parallel and transverse to the strip rolling directions.

represents the preferred composition and processing of the present invention, produced magnetic properties comparable to the quality available using generally accepted production methods.

Example 3

Figure 4:
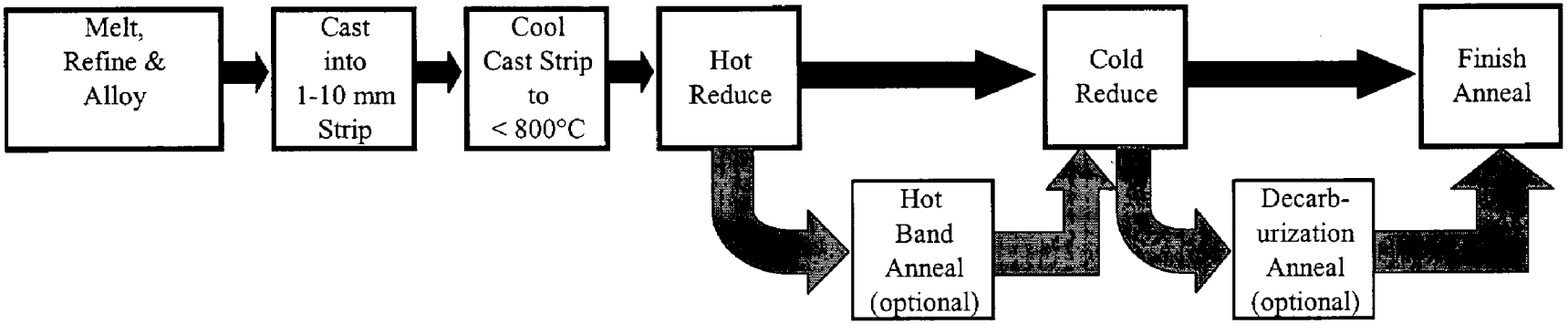
FIG. 4 is a flow diagram of the process of the third embodiment of the present invention.

Melt C shown in Table I was cast into thin strips having a thickness of either about 0.8 inch (about 2.0 mm) or about 0.10 inch (about 2.5 mm) were processed as exemplified in FIG. 4. As Table I shows, the composition of Melt C provided a volume resistivity of about 37 μΩ-cm, making the steel of Melt C representative of an intermediate-silicon non-oriented electrical steel of the art. The cast and solidified strips from Melt C were further subjected to rapid secondary cooling to a temperature below about 1000° F. (about 540° C.) strip in accordance with the preferred method of the present invention. The cast, solidified and cooled strips were reheated to a temperature of 1750° F. (about 950° C.) or about 2100° F. (about 1150° C.) in a non-oxidizing atmosphere prior to hot rolling the cast strip, the hot rolling being conducted in a single pass using about 9.5 inch (about 24 cm) diameter work rolls and a rolling speed of about 32 RPM, from a temperature below $T_{20\ wt\ \%\ \gamma}$ as defined in Equation II. The specific temperatures, reductions and calculated rolling strains calculated using Equation IX are summarized in Table IV. The hot rolled strips were pickled prior to cold rolling to a thickness of about 0.018 inch (about 0.45 mm) or annealed at about 1900° F. (about 1035° C.) in air for a time of less than about 1 minute and pickled prior to cold rolling. After cold rolling, the strips were annealed in a continuous strip anneal at a temperature of either about 1450° F. (about 790° C.) for a soak time of less than about 60 seconds in an atmosphere of 75% nitrogen and 25% hydrogen with a dew point of about 95° F. (about 35° C.), sheared into test samples, batch annealed at about 1550° F. (about 843° C.) and the magnetic properties shown in Table IV were measured in both parallel and transverse to the strip rolling directions.

TABLE III

| | | | Summary of Magnetic Properties at 1.5 T and 60 Hz | | | | | | |
|---|---|---|---|---|---|---|---|---|---|
| | | | | Parallel to Strip Rolling Direction | | Transverse to Strip Rolling Direction | | 50/50 Direction | |
| Melt | Starting Thickness of Cast Strip, inch | Final Thickness, mm | Cold Rolling Reduction, % | Core Loss at 1.5 T 60 Hz, w/kg | Magnetic Permeability at 1.5 T | Core Loss at 1.5 T 60 Hz, w/kg | Magnetic Permeability at 1.5 T | Core Loss at 1.5 T 60 Hz, w/kg | Magnetic Permeability at 1.5T |
| | | | After 1550° F, Batch Anneal Only | | | | | | |
| A | 2.5 | 0.43 | 83% | 5.49 | 2430 | 5.75 | 1770 | 5.60 | 2166 |
| B | 2.5 | 0.45 | 82% | 4.13 | 1970 | 4.30 | 1647 | 4.20 | 1841 |
| | | | 1450° F. Strip Anneal followed by 1550° F. Batch Anneal | | | | | | |
| A | 2.5 | 0.44 | 82% | 6.02 | 2320 | 6.28 | 1625 | 6.12 | 2042 |
| B | 2.5 | 0.46 | 82% | 3.60 | 2130 | 3.62 | 1867 | 3.61 | 2025 |
| | | | 1850° F. Strip Anneal followed by 1550° F. Batch Anneal | | | | | | |
| A | 2.5 | 0.44 | 82% | 5.22 | 2940 | 5.47 | 1903 | 5.32 | 2525 |
| B | 2.5 | 0.46 | 82% | 3.56 | 2499 | 3.50 | 2204 | 3.54 | 2381 |

As Table III shows, the magnetic properties of the non-oriented electrical steel from Melt A made in accordance with the present invention was acceptable; however, such properties are poorer than typical for CRNO available using generally accepted production methods. Melt B, which

TABLE IV

Summary of Magnetic Properties at 1.5 T and 60 Hz

| Melt | Heating Temperature Before Hot Rolling ° C. | Hot Rolling Temperature, ° C. | Starting Thickness of Cast Strip, mm | Thickness of Hot Rolled Strip, mm | Hot Rolling Reduction, % | Hot Rolling Strain | Final Thickness, mm | Cold Rolling Reduction, % |
|---|---|---|---|---|---|---|---|---|
| Results After Processing of the Cast and Hot Rolled Strip | | | | | | | | |
| C | 1150 | 982 | 2.4 | 1.75 | 27% | 196 | 0.46 | 74% |
| C | 1150 | 1002 | 2.4 | 1.50 | 38% | 283 | 0.45 | 70% |
| C | 950 | 871 | 2.5 | 1.83 | 27% | 352 | 0.45 | 75% |
| C | 950 | 871 | 2.5 | 1.83 | 27% | 352 | 0.45 | 76% |
| C | 950 | 832 | 2.5 | 1.73 | 30% | 518 | 0.45 | 74% |
| C | 950 | 843 | 2.0 | 1.37 | 30% | 491 | 0.45 | 67% |
| C | 950 | 827 | 2.0 | 1.04 | 47% | 1006 | 0.45 | 57% |
| Results After Processing of the Cast and Hot Rolled Strip using a Hot Band Anneal Before Cold Rolling | | | | | | | | |
| C | 1150 | 982 | 2.4 | 1.75 | 27% | 196 | 0.46 | 74% |
| C | 1150 | 1002 | 2.4 | 1.50 | 38% | 283 | 0.45 | 70% |
| C | 950 | 871 | 2.5 | 1.83 | 27% | 352 | 0.45 | 76% |
| C | 950 | 832 | 2.5 | 1.73 | 30% | 518 | 0.47 | 73% |
| C | 950 | 824 | 1.9 | 1.45 | 25% | 443 | 0.44 | 69% |
| C | 950 | 832 | 1.9 | 1.12 | 42% | 836 | 0.45 | 60% |

| | Parallel to Strip Rolling Direction | | Transverse to Strip Rolling Direction | | 50/50 Direction | | |
|---|---|---|---|---|---|---|---|
| Melt | Core Loss at 1.5 T 60 Hz, w/kg | Magnetic Permeability at 1.5 T | Core Loss at 1.5 T 60 Hz, w/kg | Magnetic Permeability at 1.5 T | Core Loss at 1.5 T 60 Hz, w/kg | Magnetic Permeability 1.5 T | Note |
| Results After Processing of the Cast and Hot Rolled Strip | | | | | | | |
| C | 3.48 | 4850 | 3.98 | 2600 | 3.68 | 3950 | * |
| C | 3.45 | 4980 | 3.64 | 3020 | 3.53 | 4196 | * |
| C | 4.65 | 4220 | 5.11 | 2250 | 4.84 | 3432 | ** |
| C | 4.54 | 4210 | 4.94 | 2280 | 4.70 | 3438 | ** |
| C | 4.45 | 4620 | 5.11 | 2240 | 4.72 | 3668 | ** |
| C | 4.40 | 4330 | 4.72 | 2780 | 4.53 | 3710 | ** |
| C | 4.34 | 3410 | 4.43 | 2480 | 4.37 | 3038 | ** |
| Results After Processing of the Cast and Hot Rolled Strip using a Hot Band Anneal Before Cold Rolling | | | | | | | |
| C | 3.43 | 4920 | 3.94 | 2610 | 3.64 | 3996 | * |
| C | 3.45 | 4780 | 3.59 | 2870 | 3.50 | 4016 | * |
| C | 3.80 | 4610 | 4.29 | 2490 | 4.00 | 3762 | ** |
| C | 4.02 | 4490 | 4.56 | 2300 | 4.24 | 3614 | ** |
| C | 3.94 | 4430 | 4.26 | 2350 | 4.07 | 3598 | ** |
| C | 4.32 | 3430 | 4.78 | 1832 | 4.51 | 2791 | ** |

Figure 5:
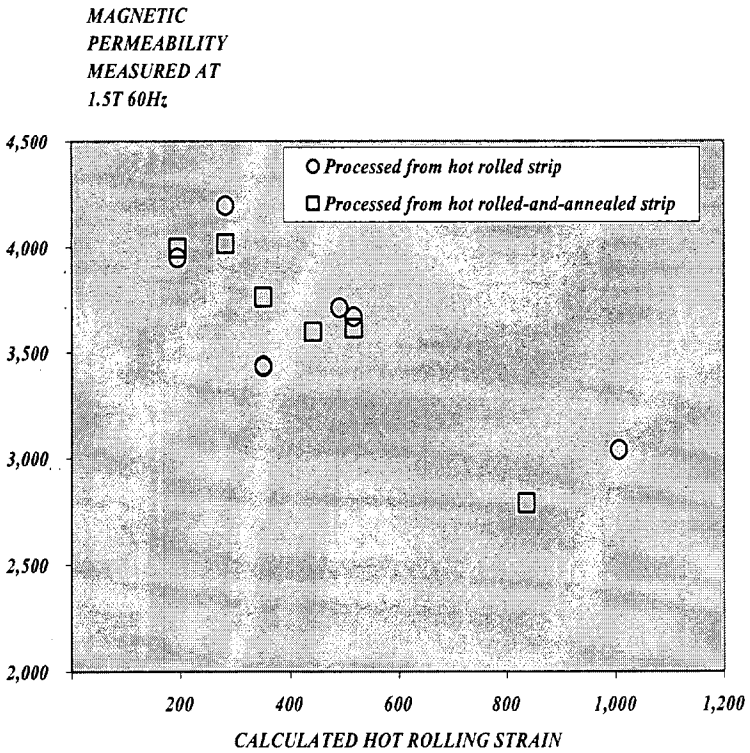
FIG. 5 is a graph illustrating the effect of the hot rolling strain on the magnetic permeability at 1.5T and 60 Hz measured on a non-oriented electrical steel of the preferred method of the present invention having a volume resistivity of about 37 $\mu\Omega$-cm.
Figure 6:
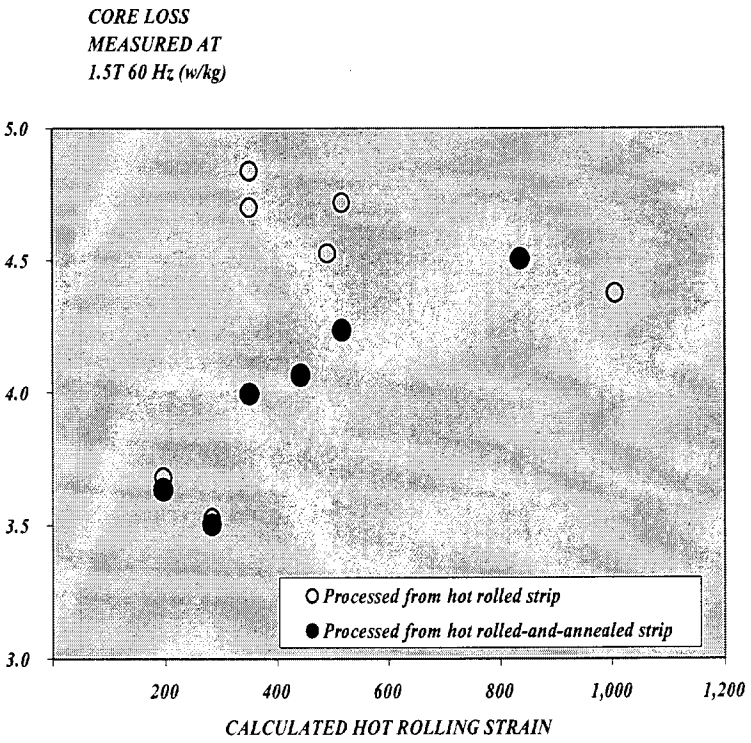
FIG. 6 is a graph illustrating the effect of the hot rolling strain on the core loss at 1.5T and 60 Hz measured on a non-oriented electrical steel of the preferred method of the present invention having a volume resistivity of about 37 $\mu\Omega$-cm.

*more preferred method of present invention
preferred method of present invention As Table IV shows, the magnetic properties of the non-oriented electrical steel from Melt C made in accordance with the present invention was comparable to generally accepted production methods both with and without an annealing step of the hot rolled strip prior to cold rolling. FIG. 5 and FIG. 6** provide a presentation of these data showing the effect of the level of hot rolling strain on magnetic permeability and core loss measured at 1.5T and 60 Hz. As Table IV and the figures make clear, an intermediate-silicon non-oriented electrical steel with very high magnetic permeability and low core loss can be produced from a thin cast strip without a hot band anneal if low strain from hot rolling, less than 300 using the formulation of Equation IX, is provided.

While it is the preferred practice of the present invention to make a high quality CRML or CRNO without an anneal of the strip prior to cold rolling and/or finish annealing, in circumstances where the cast strip is subjected to very high rolling strain, that is, greater than 300 using Equation IX, a low temperature coil-type anneal of the hot rolled strip can be provided whereby the annealing temperature substantially below $T_{20\ wt\ \%\ \gamma}$ is provided using such equipment and procedures well known in the art.

Example 4

Melt D of Table I was melted and processed wherein the cast strips were processed as exemplified in FIG. 3 in accordance with the procedure of Example 2. As Table I shows, the composition of Melt D provides a volume resistivity (ρ) representative of a high-silicon non-oriented electrical steel of the art.

TABLE V

| Melt | Starting Thickness of Cast Strip, mm | Final Thickness, mm | Cold Rolling Reduction, % | Parallel to Strip Rolling Direction: Core Loss at 1.5 T 60 Hz, w/kg | Parallel to Strip Rolling Direction: Magnetic Permeability at 1.5 T | Transverse to Strip Rolling Direction: Core Loss at 1.5 T 60 Hz, w/kg | Transverse to Strip Rolling Direction: Magnetic Permeability at 1.5 T | 50/50 Direction: Core Loss at 1.5 T 60 Hz, w/kg | 50/50 Direction: Magnetic Permeability at 1.5 T |
|---|---|---|---|---|---|---|---|---|---|
| Summary of Magnetic Properties at 1.5 T and 60 Hz | | | | | | | | | |
| After 1550° F. Batch Anneal Only | | | | | | | | | |
| D | 2.5 | 0.45 | 82% | 4.98 | 2110 | 5.05 | 1883 | 5.01 | 2019 |
| 1450° F. Strip Anneal followed by 1550° F. Batch Anneal | | | | | | | | | |
| D | 2.5 | 0.46 | 82% | 5.11 | 2410 | 5.22 | 2140 | 5.16 | 2302 |
| 1850° F. Strip Anneal followed by 1550° F. Batch Anneal | | | | | | | | | |
| D | 2.5 | 0.46 | 82% | 4.81 | 2510 | 4.83 | 2170 | 4.81 | 2374 |

As Table V shows, while the magnetic properties of the non-oriented electrical steel from Melt D made in accordance with the present invention are acceptable, the properties are poorer than typical of generally accepted production methods.

Example 5

Melt E of Table I was melted and processed wherein the cast strips were processed as exemplified in FIG. 4 in accordance with the procedure of Example 3. As Table I shows, the composition of Melt E, which embodied the preferred method of the present invention, provides a volume resistivity (ρ) representative of a high-silicon non-oriented electrical steel of the art.

As Table VI shows, the magnetic properties of the non-oriented electrical steel from Melt E made in accordance with the present invention was typical of that obtained using accepted production methods with and without an annealing step of the hot rolled strip prior to cold rolling. FIG. 7 illustrates representative microstructures after hot rolling and after cold rolling and batch annealing at 1450° F. (790° C.) for a non-oriented steel of the method of the present invention processed using low, intermediate and high levels of strain during hot rolling. These figures illustrate how excessive deformation prior to cold reduction provide a smaller, and less desirable, grain size after cold rolling and finish annealing, thereby providing inferior magnetic properties.

TABLE VI

| Melt | Heating Temperature Before Hot Rolling ° C. | Hot Rolling Temperature ° F. | Hot Rolling Temperature ° C. | Starting Thickness of Cast Strip, inch | Starting Thickness of Cast Strip, mm | Thickness of Hot Rolled Strip, mm | Hot Rolling Reduction, % | Hot Rolling Strain | Final Thickness, mm |
|---|---|---|---|---|---|---|---|---|---|
| Summary of Magnetic Properties at 1.5 T and 60 Hz | | | | | | | | | |
| Results After Processing of the Cast and Hot Rolled Strip | | | | | | | | | |
| E | 1150 | 1826 | 997 | 0.095 | 2.4 | 2.01 | 17% | 105 | 0.45 |
| E | 1150 | 1765 | 963 | 0.095 | 2.4 | 1.65 | 32% | 269 | 0.46 |
| E | 950 | 1538 | 837 | 0.094 | 2.4 | 1.83 | 23% | 371 | 0.45 |
| E | 950 | 1530 | 832 | 0.096 | 2.4 | 1.73 | 29% | 502 | 0.45 |
| E | 950 | 1538 | 837 | 0.077 | 2.0 | 1.42 | 27% | 456 | 0.47 |
| E | 950 | 1556 | 847 | 0.077 | 2.0 | 1.17 | 40% | 717 | 0.45 |
| E | 950 | 1550 | 843 | 0.077 | 20 | 1.14 | 42% | 765 | 0.47 |
| Results After Processing of the Cast and Hot Rolled Strip using a Hot Band Anneal Before Cold Rolling | | | | | | | | | |
| E | 1150 | 1826 | 997 | 0.095 | 2.4 | 2.01 | 17% | 105 | 0.46 |
| E | 1150 | 1850 | 1010 | 0.095 | 2.4 | 1.50 | 38% | 273 | 0.45 |
| E | 950 | 1538 | 837 | 0.094 | 2.4 | 1.83 | 23% | 371 | 0.45 |
| E | 950 | 1550 | 843 | 0.096 | 2.4 | 1.75 | 28% | 447 | 0.45 |
| E | 950 | 1520 | 827 | 0.076 | 1.9 | 1.40 | 28% | 494 | 0.47 |
| E | 950 | 1556 | 847 | 0.077 | 2.0 | 1.14 | 42% | 750 | 0.44 |
| E | 950 | 1550 | 843 | 0.076 | 1.9 | 1.14 | 41% | 746 | 0.45 |

TABLE VI-continued

| Summary of Magnetic Properties at 1.5 T and 60 Hz | | | | | | | | |
|---|---|---|---|---|---|---|---|---|
| | | Parallel to Strip Rolling Direction | | Transverse to Strip Rolling Direction | | 50/50 Direction | | |
| Melt | Cold Rolling Reduction, % | Core Loss at 1.5 T 60 Hz, w/kg | Magnetic Permeability at 1.5 T | Core Loss at 1.5 T 60 Hz, w/kg | Magnetic Permeability at 1.5 T | Core Loss at 1.5 T 60 Hz, w/kg | Magnetic Permeability at 1.5 T | Note |
| | | Results After Processing of the Cast and Hot Rolled Strip | | | | | | |
| E | 78% | 3.21 | 2510 | 3.44 | 1315 | 3.30 | 2032 | * |
| E | 72% | 3.19 | 3320 | 3.43 | 1294 | 3.29 | 2510 | * |
| E | 75% | 3.89 | 3050 | 4.43 | 1334 | 4.11 | 2364 | ** |
| E | 74% | 3.97 | 2910 | 4.41 | 1377 | 4.14 | 2297 | ** |
| E | 67% | 3.60 | 3090 | 3.86 | 1289 | 3.71 | 2370 | ** |
| E | 61% | 4.05 | 2210 | 4.59 | 932 | 4.26 | 1699 | ** |
| E | 59% | 3.38 | 3040 | 3.89 | 1335 | 3.58 | 2358 | ** |
| | | Results After Processing of the Cast and Hot Rolled Strip using a Hot Band Anneal Before Cold Rolling | | | | | | |
| E | 77% | 3.19 | 2590 | 3.66 | 1189 | 3.38 | 2030 | * |
| E | 70% | 3.19 | 3010 | 3.41 | 1096 | 3.28 | 2244 | * |
| E | 76% | 3.31 | 3370 | 3.81 | 1322 | 3.51 | 2551 | ** |
| E | 75% | 3.27 | 3150 | 3.77 | 1037 | 3.47 | 2305 | ** |
| E | 66% | 3.91 | 2830 | 4.09 | 1564 | 3.98 | 2324 | ** |
| E | 61% | 3.71 | 2990 | 4.10 | 1256 | 3.86 | 2296 | ** |
| E | 61% | 3.49 | 3120 | 3.92 | 1673 | 3.66 | 2577 | ** |

*more preferred method of present invention
**preferred method of present invention The results in Table VI and the figures make clear that a high-silicon non-oriented electrical steel with very high magnetic permeability and low core loss can be produced from a thin cast strip without a hot band anneal provided that low strain from hot rolling, less than 300 using the formulation of Equation IX, is provided and, with a hot band anneal, if the strain from hot rolling is less than 1000. Further, similar properties can be obtained using a hot band anneal provided that a hot rolling strain of less than 1000 is provided.

FIG. 8 shows how the % reduction and rolling temperature can be used (for steel over a wide range of T20 wt % γ) to provide a specific level of hot rolling strain. The amount of hot rolling strain determines whether or not the product can be made without annealing the hot rolled strip or using a lengthy high temperature finishing anneal.

OTHER EMBODIMENTS

While the invention has been described in conjunction with the detailed description thereof, the foregoing description and examples are intended to illustrate and not limit the scope of the invention, which is defined by the appended claims. Other aspects, advantages and modifications are within the scope of the following claims.

The invention claimed is:

1. A method for producing a non-oriented electrical steel comprising the steps of:

a) preparing a non-oriented electrical steel melt having a composition in weight % comprising:
up to about 6.5% silicon
up to about 5% chromium
up to about 0.05% carbon
up to about 3% aluminum up to about 3% manganese, and
balance essentially iron and residuals;

b) casting a steel strip by rapid solidification of the steel melt into a strip and developing an as-cast grain structure; and c) suppressing at least one of:
i) a phase change in the strip, or
ii) recrystallization of the as-cast grain structure; and d) rolling the strip to reduce the thickness of the strip, wherein the act of rolling comprises at least one act of hot rolling and the strip is reduced from greater than about 5% to less than about 90% during the at least one act of hot rolling.

2. The method claim 1 wherein the strip is reduced from greater than about 10% to less than about 60% during the at least one act of hot rolling.

3. The method of claim 1 wherein the act of rolling further comprises at least one act of cold rolling and the strip is reduced from greater than about 5% to about 90% during the at least one act of cold rolling.

4. The method of claim 1 wherein the act of rolling further comprises at least one act of cold rolling.

5. The method of claim 1 wherein the steel is cast into a strip having a thickness less than about 10 mm.

6. The method of claim 1 wherein the steel is cast into a strip having a thickness less than about 4 mm.

7. The method of claim 1 wherein the strip is recrystallized less than about 25% of the strip thickness.

8. The method of claim 1 wherein the strip is recrystallized less than about 15% of the strip thickness.

9. The method of claim 1 wherein the non-oriented electrical steel melt in weight % comprises:
about 1% to about 3.5% silicon,
about 0.1% to about 3% chromium,
up to about 0.01% carbon,
up to about 0.5% aluminum,
about 0.1% to about 1% manganese,
up to about 0.01% of an element selected from the group consisting of sulfur, selenium and mixtures thereof, up to about 0.005% nitrogen, and the balance being substantially iron and residuals.

10. The method of claim 1 wherein the non-oriented electrical steel melt in weight % comprises:

about 1.5% to about 3% silicon, about 0.15% to about 2% chromium, up to about 0.005% carbon, up to about 0.05% aluminum, about 0.1% to about 0.35% manganese, up to about 0.002% nitrogen, and the balance being substantially iron and residuals.

11. The method of claim 1 wherein the non-oriented electrical steel melt in weight % comprises up to about 1% of other elements selected from the group consisting of antimony, arsenic, bismuth, copper, molybdenum, nickel, niobium, selenium, sulfur, tin, titanium, vanadium and mixtures thereof.

12. The method of claim 1 wherein the non-oriented electrical steel melt in weight % comprises one or more elements selected from the group consisting of:

up to about 0.005% sulfur, up to about 0.007% selenium, up to about 0.15% tin, up to about 0.005% titanium, up to about 0.005% niobium, up to about 0.005% vanadium, and mixtures thereof.

13. The method of claim 1 wherein the strip is cast between two closely spaced horizontal rolls rotated in opposite directions.

* * * * *